US005803461A

United States Patent [19]

Pavlovic

[11] Patent Number: 5,803,461

[45] Date of Patent: Sep. 8, 1998

[54] MATHEMATICAL PUZZLE TYPE GAME

[76] Inventor: Zoran Pavlovic, 15445 Ventura Blvd., Suite 79, Sherman Oaks, Calif. 90403

[21] Appl. No.: 860,957

[22] PCT Filed: Dec. 19, 1995

[86] PCT No.: PCT/US95/16604

§ 371 Date: Jun. 19, 1997

§ 102(e) Date: Jun. 19, 1997

[87] PCT Pub. No.: WO96/19273

PCT Pub. Date: Jun. 27, 1996

[51] Int. Cl.[6] ..... A63F 1/00; A63F 9/04; A63F 9/20

[52] U.S. Cl. ..... 273/292; 273/146; 273/293; 273/153 R; D21/42; D21/104; D21/41

[58] Field of Search ..... 273/292, 146, 273/153 R, 293, 153 S, 275, 157 R; D21/42, 104, 41

[56] References Cited

U.S. PATENT DOCUMENTS

| | | | |
|---|---|---|---|
| 1,666,448 | 4/1928 | Hardenstein | 273/292 |
| 2,162,876 | 6/1939 | Barton | 273/275 |
| 2,228,180 | 1/1941 | Pauli | 273/293 |
| 4,659,085 | 4/1987 | DeVries | 273/236 |

FOREIGN PATENT DOCUMENTS

| | | | |
|---|---|---|---|
| 2091112 | 7/1982 | United Kingdom | 273/299 |

*Primary Examiner*—Benjamin H. Layno
*Attorney, Agent, or Firm*—Law Offices of Sandra M. Parker

[57] ABSTRACT

A game set which comprises a set of two-dimensional or three-dimensional game pieces of the same size and geometrical configuration and a method of playing with this game set, with or without a computer. In preferred embodiment, each game piece has a square-shaped playing surface. Each of the four sides of each playing surface of each game piece has a selected visible indicia. The criteria determining how the indicia are to be arranged on the sides are mathematically selected so as to permit the use of the game as a mathematical puzzle that may be played by one player, played competitively by two players, or for other purposes of entertainment or intellectual simulation. In many of the games, the game pieces are arranged in a mutually abutting side-by-side relationship, whereby the indicia on each of the sides may match and align with the indicia on respective abutting sides of other game pieces of the set, and with the top surfaces of the abutting game pieces forming a square.

16 Claims, 9 Drawing Sheets

LEGEND:
BLUE
RED
BLACK

LEGEND:

BLUE

RED

BLACK

LEGEND:

BLUE

RED

BLACK

LEGEND:

BLUE

RED

BLACK

LEGEND:

BLUE

RED

BLACK

LEGEND:

BLUE

RED

BLACK

LEGEND:

BLUE

RED

BLACK

LEGEND:

BLUE

RED

BLACK

MATHEMATICAL PUZZLE TYPE GAME

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

PRIORITY DECLARATION

This applicant is claiming priority based on an earlier U.S. application, Ser. No. 08/359054, entitled Mathematical Puzzle Type Card Game, filed on Dec. 19, 1994 now U.S. Pat. No. 5,524,898.

TECHNICAL FIELD OF INVENTION

The present invention relates generally to the field of intellectual game sets. In particular, this invention relates to a mathematical puzzle game set, having a predetermined plurality of game pieces with playing surfaces having visible indicia, which can be placed on two-dimensional cards or three-dimensional tiles or dice, and useful to create a mathematical puzzle that may be played by one player, played competitively by two or more players or against a computer, or for other purposes of entertainment or intellectual simulation, and a method of playing with this game set.

BACKGROUND ART

There is always a need for new games that are intellectually stimulating and interesting, and can be played with a minimum of physical inconvenience to the participants. There is a need for multi-player games and also for games for a single player.

Some examples of game sets are found in U.S. Pat. No. 4,410,180 issued to Clark on Oct. 18, 1983 and in U.S. Pat. No. 4,067,580 issued to Tzeng on Jan. 10, 1978.

DISCLOSURE OF INVENTION

According to the present invention, a game set consisting of a predetermined plurality of game pieces is provided, having playing surfaces with visible indicia, which can be placed on a deck of two-dimensional cards for various card games and mathematical puzzles, on three-dimensional tiles, for a modified form of the well-known Dominos or other games, or on faces of a set of dice.

The basic game set comprises a set of game pieces of the same size and geometrical configuration, each having a square-shaped playing surface, upon each side of which there is a selected visible indicia. The criteria are mathematically selected so as to permit the use of the game as a mathematical puzzle that may be worked on by only a single player, a competitive mathematical puzzle game that is played competitively by several players at the same time, or for other purposes of entertainment or intellectual stimulation.

In many of the methods of playing the games utilizing this game set, and played with or without a computer, the game pieces are arranged in a mutually abutting side-by-side relationship, whereby the indicia on each of the sides may match and align with the indicia on a side of another game piece of the set, and with the top surfaces of the game pieces forming a square. Other games can be played without requiring that specific relationship.

This game set possesses an advantage over most game sets already known to human kind. The playing surfaces described in the game set can be placed on objects with different physical characteristics, allowing unlimited number of games to be played, some of them resembling most popular games played by several people, like dominoes, gin etc., or played in solitaire by creating puzzles. Moreover, each game set is easy to understand, memorize, play, make, handle, store and program in a computer. Further, it is ideal for people of all ages and nationalities, since the indicia chosen are very simple and represented by stripes, the game pieces are color-coded for easy visual recognition, and no reading, translation or counting is necessary.

BEST MODE FOR CARRYING OUT THE INVENTION

Detailed Description of Basic Game Set

Figure 1:
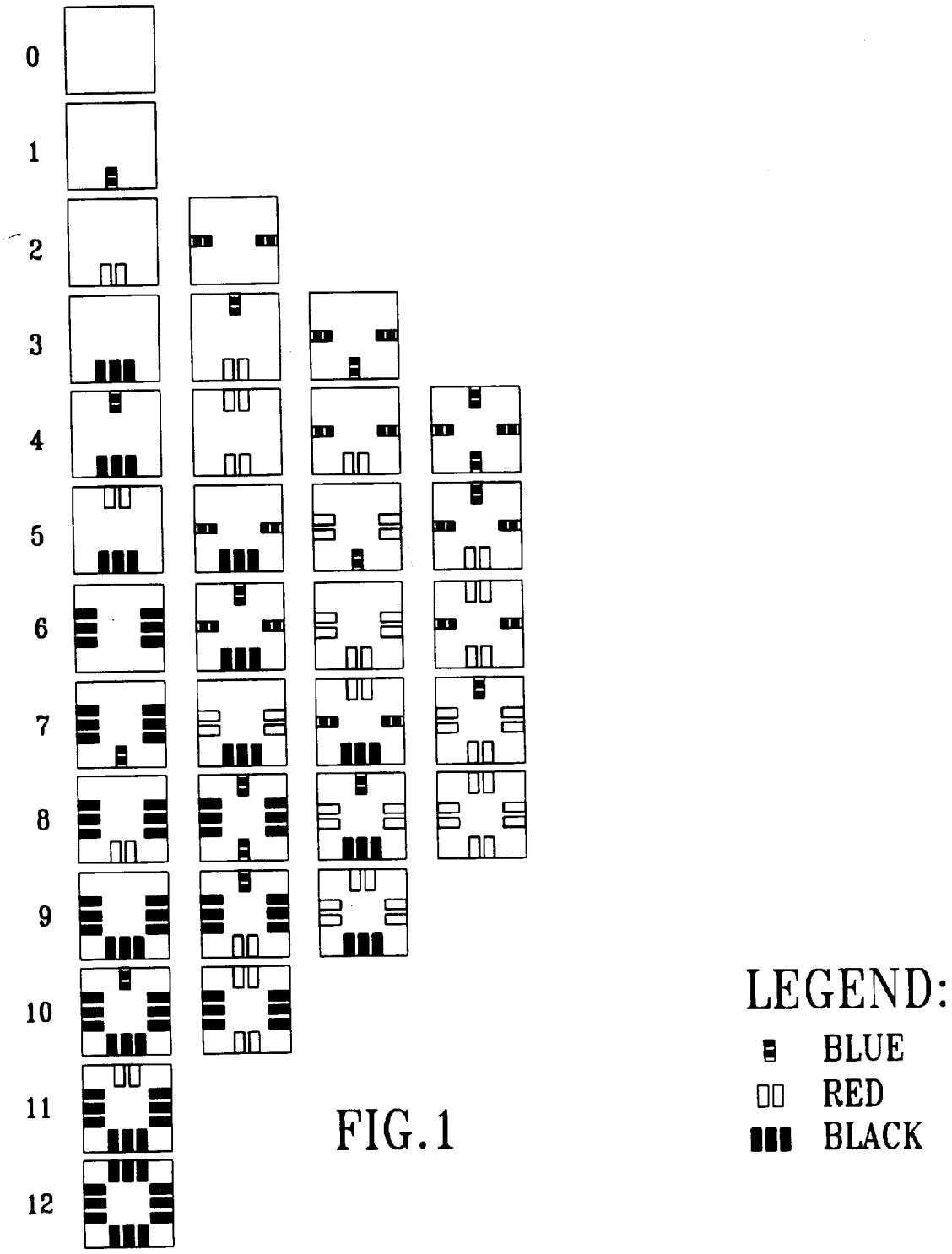
FIG. 1 is a top plan view of a basic game set of thirty-four two-dimensional game pieces, in accordance with the invention.

Reference is now made to the basic game set shown in FIG. 1, representing two-dimensional game pieces, as in a deck of cards, and having one playing surface per each game piece. It will be noted that the game pieces are arranged in four rows, and the game pieces in the longest row are numbered from "0" to "12", inclusive. It will also be seen that the indicia are color-coded. The "0" game piece has no visible indicia; that is, its indicia on all four sides is a blank space. The "12" game piece, however, has three black stripes on each of its four sides, for a total of 12 stripes.

In this basic set of thirty-four game pieces, there are four types of indicia that distinguish the various sides of the various game pieces. One is a blank space, of which there are four on the "0" game piece. A second indicia is a single blue stripe, such as that which appears in the lateral center of one side of the "1" game piece. A third indicia is a parallel pair of red stripes, such as those that appear in the lateral center of one side of the "2" game piece. A fourth indicia is the set of three black stripes, such as those appearing on all four sides of the "12" game piece.

Further, the "3" game piece has only three black stripes on one of its sides; the "4" game piece has a single blue stripe on one side and three black stripes on the opposite side; the "5" game piece has two red stripes on one side and three black stripes on the opposite side; the "6" game piece has three black stripes on each of two opposite sides; the "7"

game piece, in addition to six black stripes like the "6" game piece, also has a single blue stripe on another side; the "8" game piece has the same six black stripes plus two red stripes on another side; the "9" game piece has three black stripes on each of three sides; the "10" game piece has three black stripes on each of three sides plus a blue stripe on a fourth side; and the "1" game piece has three black stripes on each of three sides and a pair of red stripes on the fourth side.

In the second row of game pieces in FIG. 1, there are game pieces only from "2" to "10", inclusive. The "2" game piece has two blue stripes on opposite sides of the game piece; the "3" game piece has one blue stripe on one side and two parallel red stripes on the opposite side; the "4" game piece has two pairs of red stripes on opposite sides; the "5" game piece has two blue stripes on opposite sides, and a set of three black stripes on one of the intermediate sides; the "6" game piece has a single blue stripe on each of three sides and three parallel black stripes on the fourth side; the "7" game piece has two pairs of red stripes on opposite sides and a set of three black stripes on one of the intermediate sides; the "8" game piece has two sets of three parallel black stripes on opposite sides and two blue stripes on the other two opposite sides; the "9" game piece has two sets of three black stripes on opposite sides, two red stripes on one intermediate side, and one blue stripe on the other intermediate side; and the "10" game piece has two sets of three black stripes on opposite sides and two pairs of red stripes on the other two opposite sides.

In the third row of game pieces in FIG. 1, there are game pieces only from "3" to "9", inclusive. The "3" game piece has two blue stripes on opposite sides of the game piece and one blue stripe on an intermediate side; the "4" game piece has two blue stripes on opposite sides and a pair of red stripes on an intermediate side; the "5" game piece has two pairs of red stripes on opposite sides, and a single blue stripe on one of the intermediate sides; the "6" game piece has a pair of red stripes on each of three sides; the "7" game piece has one blue stripe on each of two opposite sides, a set of three black stripes on one of the intermediate sides, and a pair of red stripes on the other intermediate side; the "8" game piece has two pairs of red stripes on opposite sides, a blue stripe on one of the intermediate sides, and three black stripes on the other intermediate side; and the "9" game piece has two red stripes on each of three sides and three black stripes on the fourth side.

In the fourth row of game pieces in FIG. 1, there are game pieces only from "4" to "8", inclusive. The "4" game piece has one blue stripe on each of its four sides; the "5" game piece has blue stripes on each of three sides and a pair of red stripes on the fourth side; the "6" game piece has a pair of red stripes on each of two opposite sides and one blue stripe on each of the other two opposite sides; the "7" game piece has one blue stripe on one side and a pair of red stripes on each of the other three sides; and the "8" game piece has a pair of red stripes on each of the four sides.

It will therefore be seen that, by counting a blank space as a numerical "0", the "0" game piece has a total count of "0"; whereas, by counting each stripe as "1", each of the other game pieces has a total count equal to its number. For example, the "8" game piece in each of the four rows has a total count of eight, but there is a different set of indicia in each row to accomplish that result.

It will be seen that in the basic game set of FIG. 1, each game piece is symmetrical about a central dividing line. That is, if a dividing line were drawn vertically through the center of each game piece, that portion of the game piece on the right side of the dividing line will be a mirror image of that portion of the game piece remaining on the left side of the dividing line.

Use of Basic Game Set

K-9 Game

The usefulness and versatility of the basic game set can be seen, for example, in the game that I call K-9. In the game of K-9 it is desirable to remove the "0" and "12" game pieces, the "4" game piece in row four that has four separate blue stripes, and the "8" game piece in row four that has four pairs of red stripes. This then leaves a playing deck of thirty game pieces.

The K-9 game is then played by dealing, at random, nine game pieces to each player. There may be one, two, or three players. The object for each player is to arrange his or her nine game pieces into a three-by-three square, in which all of the abutting pairs of sides of the game pieces have matching and aligned indicia. This will be more clear by reference to FIGS. 2A, 2B, and 2C.

Figure 2A:
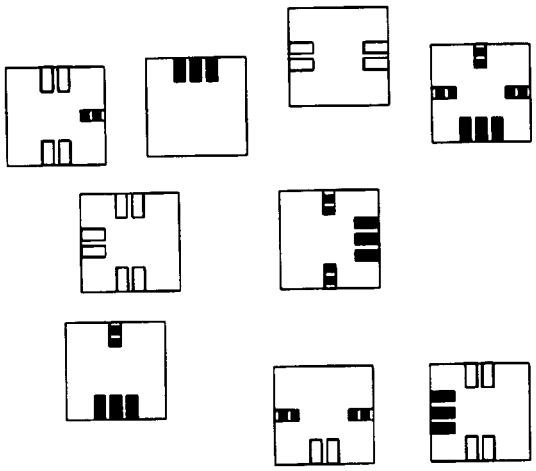
FIG. 2A illustrates a random selection of nine of the game pieces of the basic game set of FIG. 1.
Figure 2B:
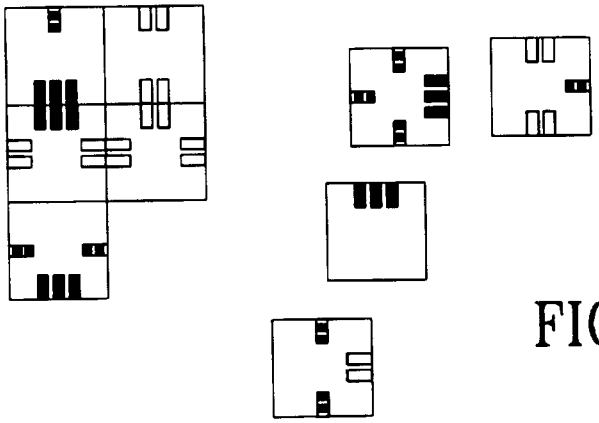
FIG. 2B illustrates a partial re-arrangement of the nine game pieces of FIG. 2A, in order to bring them into a matching side-by-side relationship.

As shown in FIG. 2A, the nine game pieces are laid out in a generally square configuration but there are no abutting sides that match. In FIG. 2B, it can be seen how certain ones of the same game pieces have been rearranged into abutting relationship in which the adjacent sides are matching. It should be noted that, to accomplish that result, certain game pieces have to be moved from their original location to a different location, and, also, to be rotated by one or more quarter turns, in order to achieve the desired result.

Figure 2C:
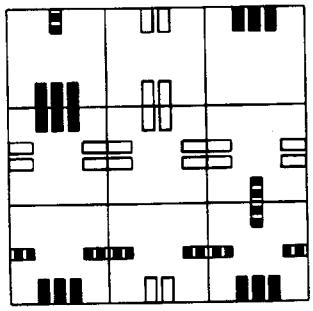
FIG. 2C illustrates the same nine game pieces when arranged in a three-by-three square, with all of the abutting sides having matching and aligned indicia.

FIG. 2C shows the same group of nine game pieces when the matching and alignment process has been completed. Each side of each game piece, that is inside the square, is in abutting relationship with a side of another game piece, and the indicia on the two abutting sides not only match in number and color but are also aligned.

In the three-by-three square configuration of nine game pieces, there are at least four million possible combinations. By far, the greatest number of these will work to achieve the matching and aligned relationship of indicia, as shown in FIG. 2C. There are a few combinations, however, where a match is not possible. For example, if one of the indicia appears only in a double form on opposite sides of the same game piece, a match is not possible.

To reduce the likelihood of having a group of nine game pieces that cannot be matched, it is desirable to remove three additional game pieces from the basic set, reducing the number to twenty-seven. The game pieces to be removed should be the "6" game piece of row four, having two pairs of red stripes and two single blue stripes; the "8" game piece from row two, having two sets of three black stripes and two single blue stripes, and the "10" game piece in row two, having two sets of three black stripes and two pairs of red stripes. With those three game pieces removed, the likelihood of running into an impasse is greatly reduced. Furthermore, if there are three players, the remaining twenty-seven game pieces can be evenly divided among those three players.

It would also be possible to further reduce the likelihood of an impasse by removing three more game pieces: the "2" game piece in row two, having two blue stripes on opposite sides of the game piece, the "4" game piece in row two, having two pairs of red stripes on opposing sides, and the "6" game piece in row one, having three black stripes on opposing sides, reducing the number of game pieces in the set to twenty-four.

The same puzzle game can also be played by two player, receiving five game pieces each, and each player placing his game pieces in turn, until the puzzle is solved or no more game pieces can be added. One point is awarded for each stripe of the indicia matching with the other pieces of the puzzle. If any game piece is left in hand, number of stripes still held in hand is subtracted from the total number of points. The game is repeated until the game set is exhausted or until agreed-upon total number of points has been reached.

Four-By-Four Squares

The basic game set may also be used by dealing out sixteen game pieces at random. There are more than two billion possible combinations of any sixteen game pieces. This group of game pieces can then be arranged into a four-by-four square, with matching and alignment of indicia on the abutting sides of the game pieces. There are a few of the possible combinations which can not be made to work in this way, but I have played several thousand of the sixteen-pieces groups and have not yet run into an impasse in forming the desired four-by-four square.

Dominator Game

Another game that can be played with the basic game set I have named DOMINATOR. Two, three, four or more persons may play the game, each player for himself, four individuals can play in two partnerships, etc.

The object of play is to score points during the game as much as possible. The game pieces of the basic game set are first placed face-down and shuffled. Each player takes four game pieces for two-player or four-player game or five for three-player game, from the pile for his hand. For the first play, a game piece from the pile is laid face-up on the table. The layout is open in all four directions, and all open ends or ends which are not abutting against another game piece are countable. During play, the existing layout is maintained and expanded, and points are counted on each play. To make points, the stripes on all sides are added. For example, if the first laid down game piece is "5" or "10", the dealer receives the points.

A game piece from a player's hand is laid down with one of its sides to be matched against one of the sides of a game piece already down. Total number of stripes of the open ends on the outside of the figure created is added up and, if the total is a multiple of five, the points are made. Now, there are two game pieces on the table and play is open on six ways.

For example, if the dealer turns over a "5" game piece having three black stripes and two blue stripes, he scores five. When the second player places a "7" game piece, that has three double red stripes and one blue stripe with blue stripes of the two game pieces matched, then the outside sides of the two game pieces add up to ten, and the player has then scored ten. When player has no playable game pieces, he loses his turn and a game piece from his hand is put off to the player's side. Each player, in turn, plays one game piece until no game pieces remain in any player's hand. After all game pieces have been played or set aside, players who had to set aside game pieces total up the value of their set-aside game pieces and the other players receive that value, rounded off to the closest multiple of five. For example, seven counts as five and eight as ten. The game pieces are then reshuffled and play continues in the above-mentioned procedure, until one player reaches a certain point total. Players can agree to the desired point total for determining a winner. In two-player game, the first to reach two hundred points wins a game.

Red Alexa Game

This game is played by two players. At the beginning of the game, two game pieces are removed from the basic game set, the game piece with three black stripes on all four sides, and the game piece without any stripes. Each player is dealt four game pieces. The first player places one game piece on the playing surface, declares which indicia on that game piece is the "called" indicia, the indicia that other player has to respond to, and turns that side of the game piece towards the opponent. The other player must answer with the game piece that has at least one of the "called" indicia. If he does not have such a game piece, he can respond with any other piece. Player who played a game piece with the highest point value takes that hand.

The highest point value of the hand is determined using following hierarchical rules:

1. highest number of the "called" indicia on a game piece;
2. if equal number of "called indicia" on both game pieces, then the higher total number of stripes on the remaining sides of the game pieces;
3. if equal number of "called indicia" on both game pieces, and equal total number of stripes on the remaining sides of the game pieces, the game piece having the indicia with the highest number of stripes on the same side.

If the player had the game piece with it, but did not respond to the indicia "called", he is punished by getting maximum number of points and that game is over.

After the taking of the hand, both game pieces are removed and put on the side face down. Next, the player who took previous hand plays first. When all of the dealt game pieces are used, the dealer deals four more game pieces to each of the players. Game continues until all of the game pieces in the deck are used. At that time, the points are counted and the player with less points wins the game.

The maximum number of points in one game is forty five. Only the stripes on the sides having the same preferred type of the indicia are counted, preferably the indicia having one blue stripe. The total number of stripes in this preferred type of indicia is thirty-four. "Red Alexa" game piece (game piece with two red stripes on each of the four sides) carries eight points. The player with the most game pieces without preferred type of indicia and without "Red Alexa" game piece gets additional three points at the end of the play.

The game continues until one of the players reaches the agreed upon total number of points, for example one hundred and fifty points, and looses the game. However, if one of the players believes that his opponent has reached one hundred and fifty points, by adding his total score and points accumulated in the present game, he may "call" and stop the game and points are counted. If the opponent has at least one hundred and fifty points, then the player who "called" wins that game. If the opponent has less than one hundred and fifty points then the player who "called" looses that game.

Addiction Game

This game is preferably played by one player. The object of this game is to take as many points as possible. At the beginning of the game, two game pieces are removed from the basic game set, the game piece with three black stripes on all four sides, and the game piece without any stripes. Eight game pieces from the set are placed face up on the playing surface. Player removes two game pieces with exactly twelve stripes on both game pieces, and places them face down on the side. He receives number of points equal to the number of stripes on the sides of the removed game pieces that match on both game pieces, one point for matching one stripe, two points for matching two stripes and three points for matching three stripes. Therefore, the player tries to match the game pieces having exactly twelve stripes on both game pieces and a maximum number of matching sides with indicia having the higher number of stripes.

Two new game pieces from the set are used to replace the game pieces removed. If there are no more game pieces remaining in the set, the player keeps on removing two game pieces with a total of twelve stripes until all of the game pieces are removed. The game continues until all of the game pieces in the set are used, or until there are no game pieces on the playing surface having exactly twelve stripes. The maximum number of points in one game is forty six.

Zonk Game

This game is played by two, three or four players. The object of the game is to match game pieces in hand into one or more suits. A suit consists of two, three, four, five, or six game pieces which have three sides with matching indicia in the same order on each game piece. A player with all six game pieces in hand, arranged in one or more suits, has a "zonk".

The game starts by dealing five game pieces to each of the players. The remaining game pieces are put on the playing surface, face down, in a stack. The first player takes one game piece from the stack and tries to match game pieces in hand into suits. If he has a "zonk", he announces it and ends that play, receiving three points and a sum of the points of all other players. If he does not have a "zonk", the player then discards one of his game pieces, face up, and starts the "discard stack". Play continues with the next player who can take one game piece from the stack of unused game pieces or from the top of "discard stack" and until one of the players announces a "zonk" hand or chooses to "knock".

Before taking the sixth game piece, at any time during the game, a player has an option to announce a "knock", if he thinks that he has the lowest hand. The value of a hand is determined by adding number of stripes that are unmatched on all the game pieces that are part of the suits and the highest number of stripes on any one side of the game pieces which are not part of any suit.

If the player who decided to "knock" has, in fact, the lowest hand, he will earn points equal to number of points in his hand. Each of the opponents will have subtracted from their total scores the number of points in his hand and the number of points in the hand of the player who opted to "knock". If the player who decided to "knock" does not have the lowest hand, he will have thirteen penalty points subtracted, as well as the points in his hand. The player with actual lowest score will earn points as if he had called the "knock".

Any player who chooses to draw a sixth game piece may announce "zonk" and place his game pieces face up on the playing surface so that his opponents can view them. The player with "zonk" is awarded the total of points from the opponents' hand plus three bonus points. The game continues until a player reaches a total number of points agreed upon.

Description of Expanded Game Set

Figure 3:
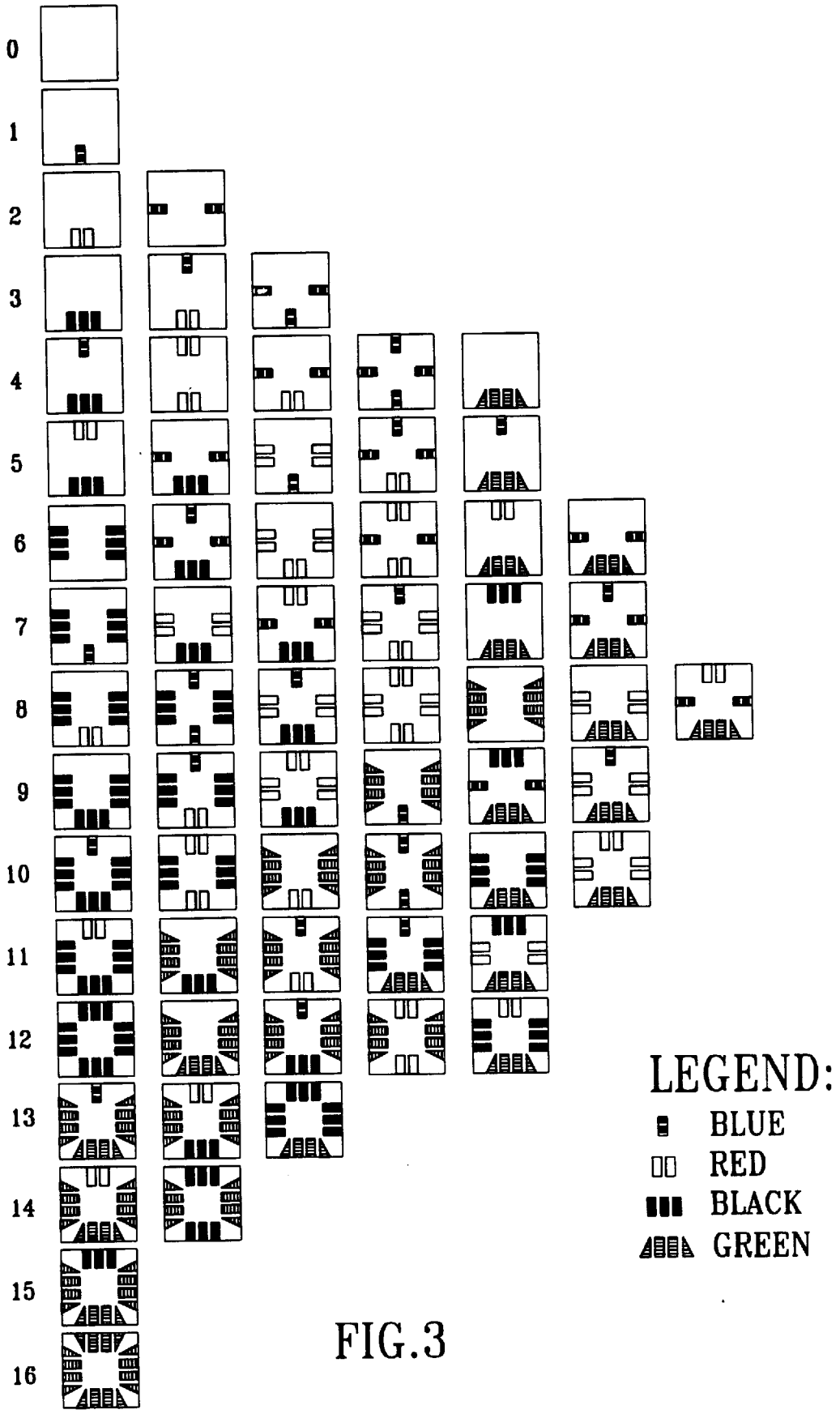
FIG. 3 illustrates an expanded set of sixty-five two-dimensional game pieces, in accordance with the invention.
Figure 4A:
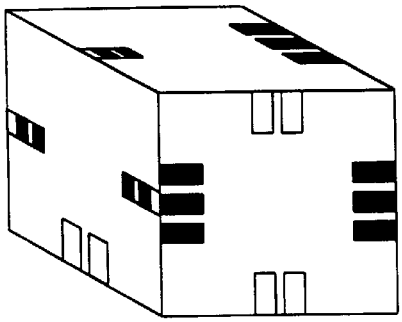
FIGS. 4A, 4B, 5A, 5B, 6A, 6B, 7A, 7B, 8A, 8B, 9A and 9B illustrate front and back perspective views, respectively, of each die from a set of six dice, having on their faces game pieces from the basic game set of FIG. 1.
Figure 4B:
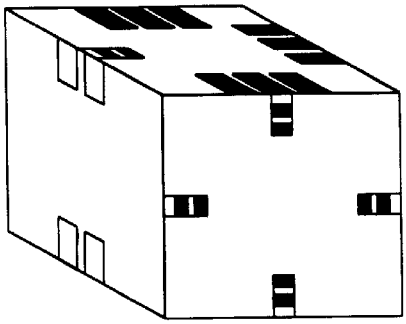
Figure 4C:
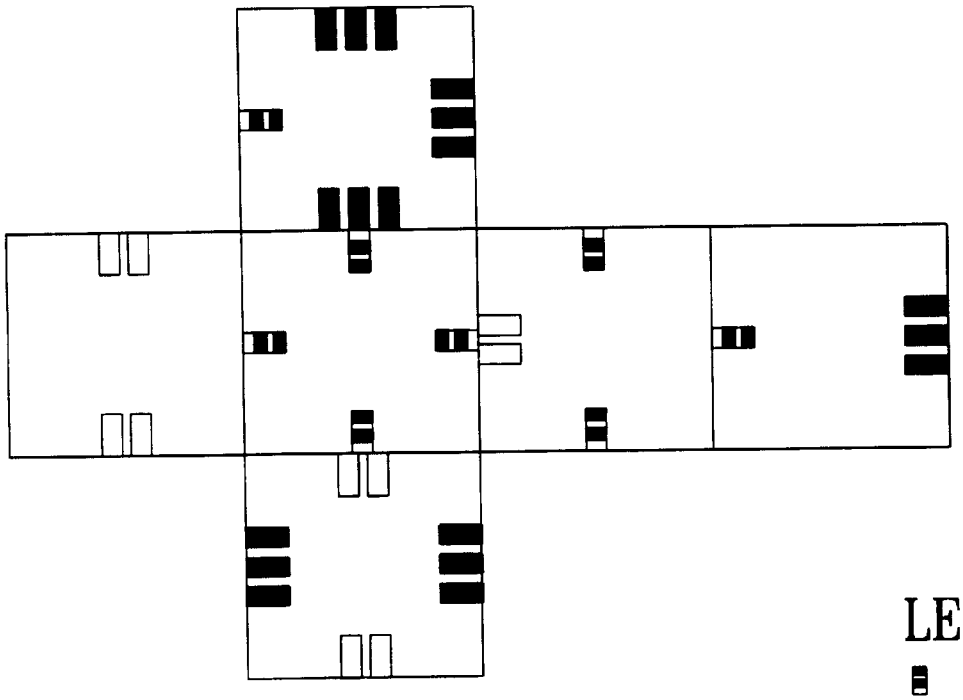
FIGS. 4C, 5C, 6C, 7C, 8C and 9C illustrate plan view of each die from the same set of six dice, showing on all six faces of each die game pieces from the basic game set of FIG. 1.
Figure 5A:
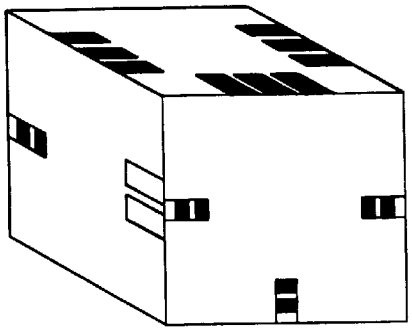
Figure 5B:
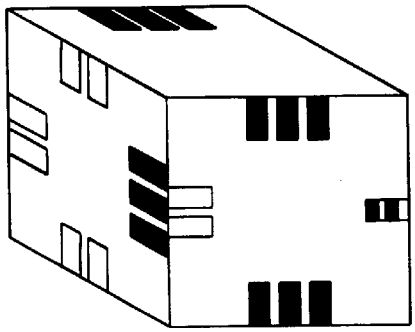
Figure 5C:
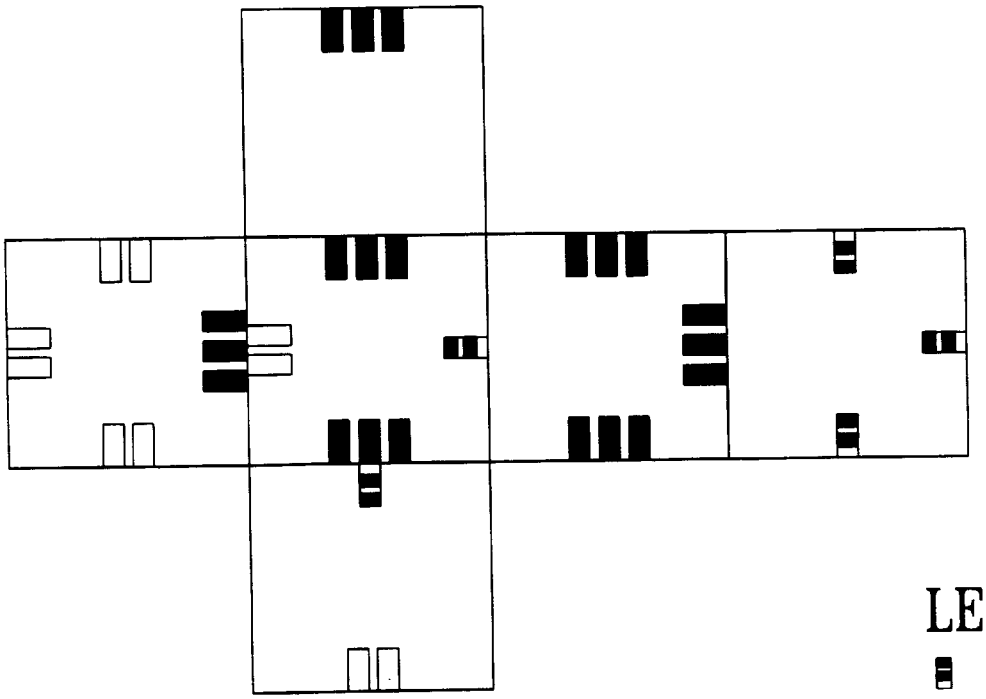
Figure 6A:
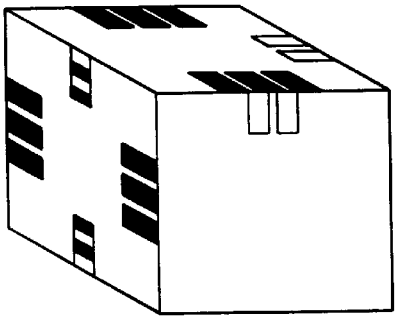
Figure 6B:
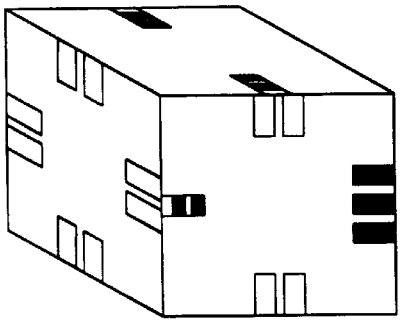
Figure 6C:
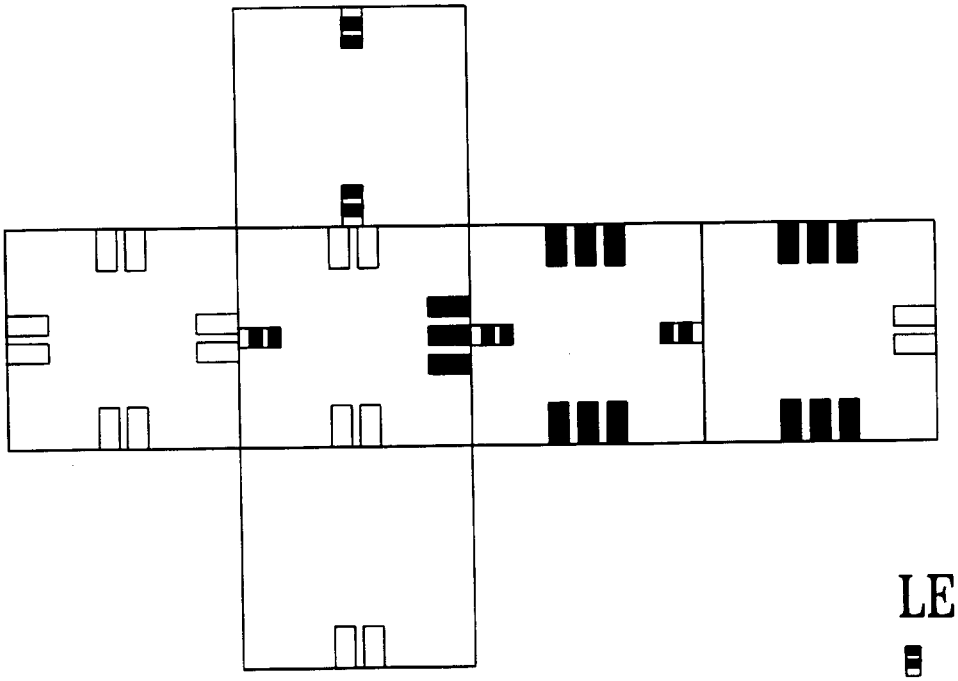
Figure 7A:
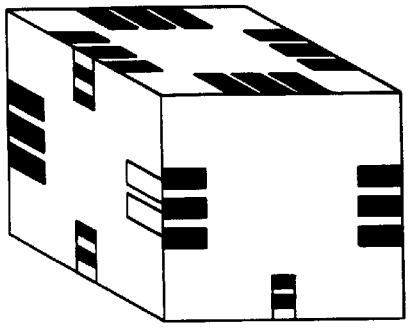
Figure 7B:
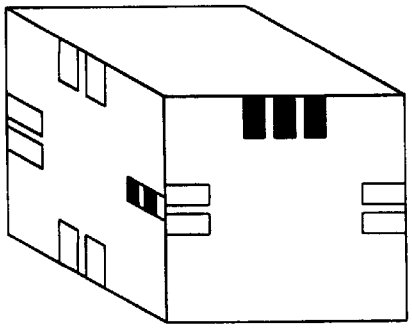
Figure 7C:
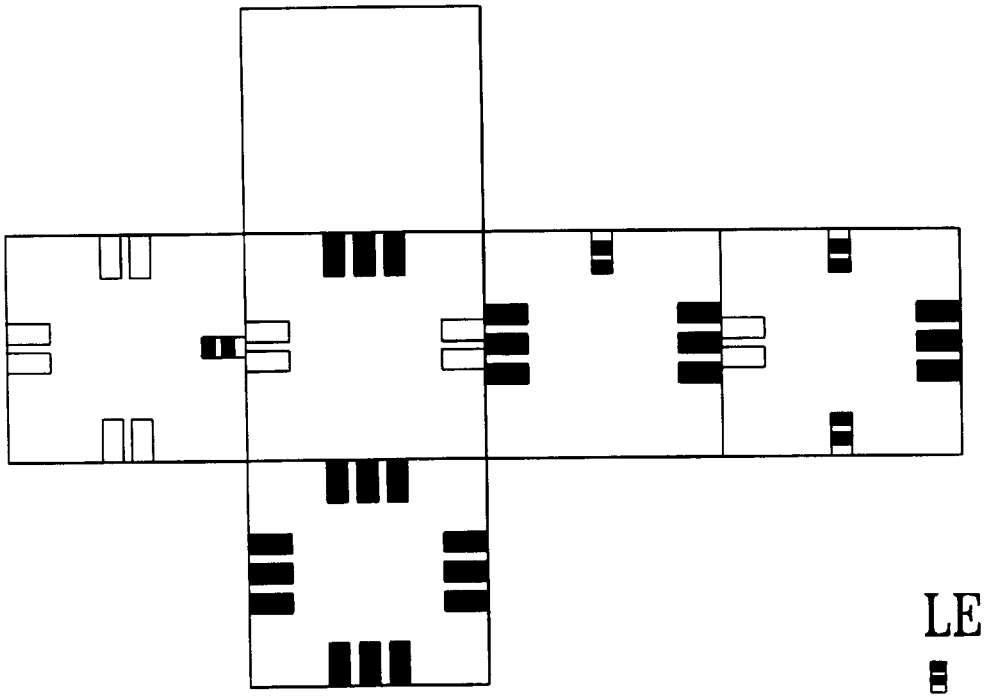
Figure 8A:
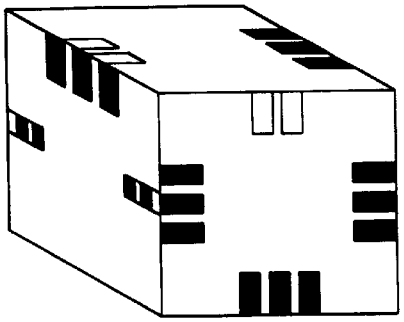
Figure 8B:
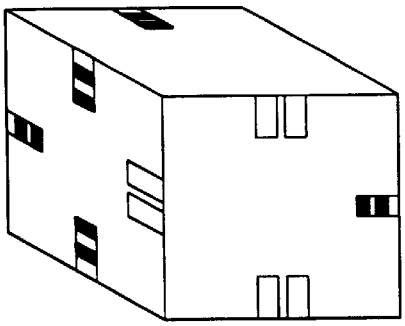
Figure 8C:
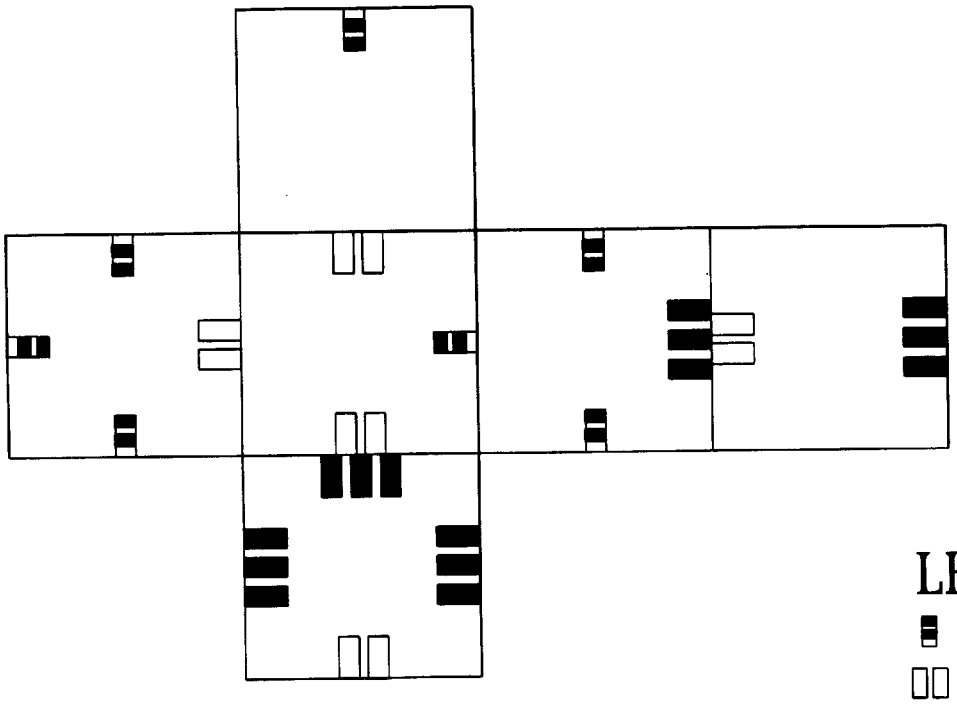
Figure 9A:
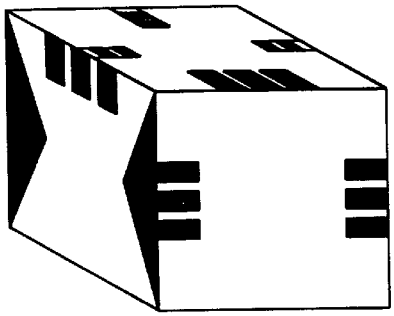
Figure 9B:
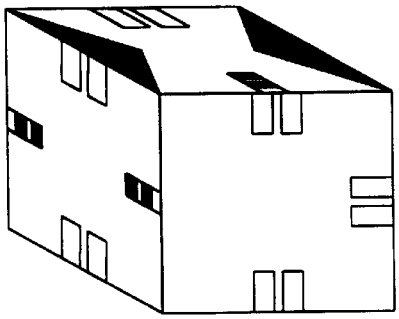
Figure 9C:
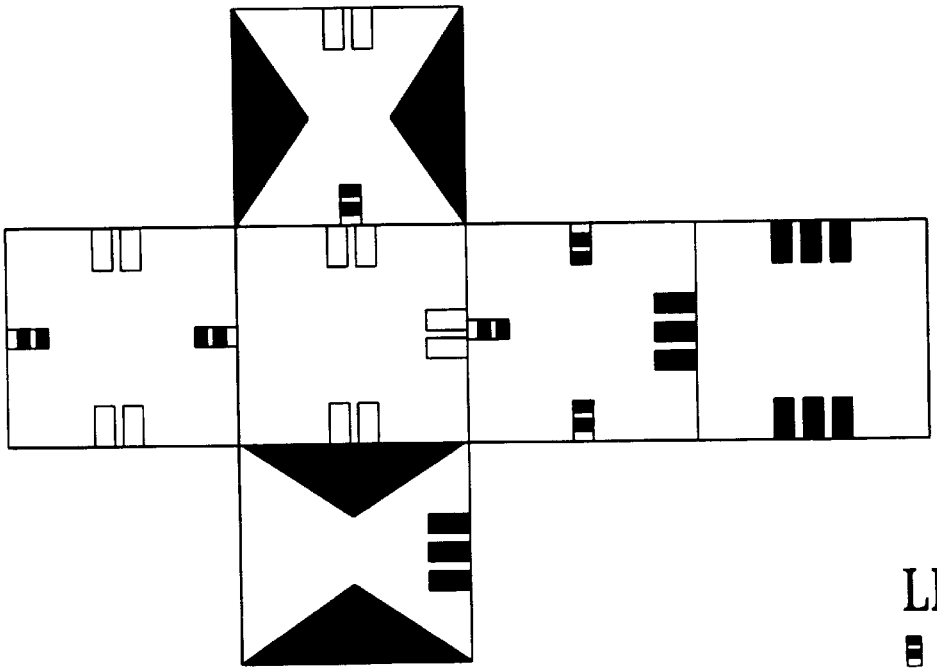

Reference is now made to FIG. 3, illustrating the expanded game set, in accordance with the invention. It will be seen that all of the thirty-four game pieces of the basic set are still used. In addition, a fifth type of indicia is used so as to identify a larger number of game pieces. The fifth indicia, as shown in the present illustration, consists of four green marks placed in a generally parallel relation, on one side of the game piece. As presently shown, only the two inner marks could be called "stripes", while the two outer marks have corners cut off and are actually triangles. It will be understood, however, that the exact nature and shape of the indicia that are used would not be critical to the invention and that the invention can be carried out using modified forms of such indicia.

In the expanded game set of FIG. 3, there are sixty-five game pieces and there are five different types of indicia, each of which appears a total of fifty-two times. Each of the indicia appears at least once on thirty-one of the game pieces, and each indicia appears only once on sixteen game pieces, only twice on ten game pieces, only three times on four game pieces, and on all four sides of only one game piece.

Unsymmetrical Game Pieces

The concept of the present invention can be extended to create game pieces that are unsymmetrical. For example, if a single blue stripe is on one side of the game piece and another one is on an adjacent side, the two stripes are at an angle of ninety degrees to each other. In another example, three black stripes can be placed on one side of a game piece and two red stripes on an adjacent side, at an angle of ninety degrees to the black stripes. Constructing the game pieces in that way greatly increases the number of game pieces configurations that are possible, since there may be an unsymmetrical left version and an unsymmetrical right version of the same game piece, etc.

The symmetrical game piece designs, as shown in the drawings, represent the presently preferred way of carrying out the invention. Thus, according to the invention, the basic set of thirty-four symmetrical game pieces and the expanded set of sixty-five symmetrical game pieces are presently preferred. In the symmetrical arrangement, each indicia, other than blank, is laterally centered on the associated side of the game piece so as to facilitate alignment of that indicia when two game pieces are placed in abutting side-to-side relationship. Further, if only two indicia, other than blank, are used on a game piece, they are on opposite sides, not adjacent sides, and are symmetrical relative to a center line running between the opposite sides.

Other Game Configurations

The principles of the present invention can be applied to game pieces with other geometrical forms, such as triangular. However, from using the triangular game pieces I have found that the possibilities are much more limited. Also, mechanical handling of triangular game pieces is less convenient than for the square game pieces. Other configurations may also be used, such as pentagon or sextagon.

My game pieces can be two-dimensional, as presented earlier, and used as cards in a card deck. However, in some applications it is not feasible to use paper or cardboard cards for game pieces, particularly for the games with the rules similar to those of the well-known Dominos game. In that instance, I prefer to make game pieces of rigid tile members, having one playing surface per tile, with playing surfaces chosen from the basic or expanded game set.

Use on Dice

Another use of my game pieces is to put them onto a set of six or more dice. Each individual dice has six faces, making a total of minimum thirty-six faces for the set. Sometimes, I use all thirty-four game pieces from the basic game set as dice faces and use two remaining faces designated as "wild cards" or Jokers, to substitute for an indicia in any suitable manner, preferably both located on the same die. Sometimes, I prefer to omit the "0" game piece and use three remaining faces, designated as Jokers, on three separate dice, either selected at random or in some particular desired arrangement.

FIGS. 4A, 4B, 5A, 5B, 6A, 6B, 7A, 7B, 8A, 8B, 9A and 9B illustrate front and back perspective views, respectively, of each die from a set of six dice, having on their faces game pieces from the basic game set of FIG. 1. FIGS. 4C, 5C, 6C, 7C, 8C and 9C illustrate plan view of each die from the same set of six dice, showing on all six faces of each die game pieces from the basic game set of FIG. 1. In this configuration, all game pieces from the basic game set having the same numerical significance (i.e., "2", "3", etc.) are placed on the same die and none of the indicia on one face abuts the same type of indicia on another face of the same die.

Computerized Embodiment

While the invention is presently illustrated in the form of tangible and visible game pieces, both basic and extended game sets and mathematical principles and concepts of numerous games can be easily incorporated into computer programs to be used in microprocessor-based computer systems. The microprocessor can then be used to reject game pieces combinations that would not be workable in the particular game context planned or play as one or more opponents against a human player.

The computer system should have a microprocessor, a computer memory unit, an input unit, a video display unit and adequate software programs for playing numerous video games, some of which have been described herein, and can use the same game sets as previously illustrated, with game pieces including cards, tiles or dice.

What is claimed is:

1. A game set comprising:

a predetermined total number of different game pieces, including cards, tiles or dice;

each said game piece having an at least two-dimensional body and at least one geometrically identical playing surface;

each said playing surface of each said game piece having at least four sides;

each said playing surface upon each of its at least four sides is characterized by a selected indicia, chosen from at least four and maximum five different types of said indicia, wherein each said type of said indicia appears at least once on some of the playing surfaces, at least twice on some of the playing surfaces, at least three times on some of the playing surfaces, and at least four times on some of the playing surfaces said indicia on the sides of the playing surface of each of said game pieces forming a pattern wherein the playing surface of each of said game pieces and the pattern on each of said game pieces being symmetrical about a central dividing line;

each of said indicia having a different numerical significance and being laterally centered on the associated side of the playing surface, so as to facilitate alignment of two of said indicia whenever the playing surfaces of the two game pieces are placed in an abutting side-to-side relationship; and on each playing surface, where the particular type of said indicia appears only twice, it is on the opposite sides of the playing surface and not on the adjacent sides of said playing surface.

2. A game set as in claim 1 wherein said total number of different game pieces is sixty-five, each said game piece having only one square-shaped playing surface, there being a total of five different types of said indicia, said game set being further characterized in that each of said type of said indicia appears a total number of fifty-two times, each of said type of said indicia appears at least once on each of thirty-one playing surfaces, and each of said type of said indicia appears only once on each of sixteen playing surfaces, only twice on each of ten playing surfaces, only three times on each of four playing surfaces and on all four sides of only one playing surface.

3. A game set as in claim 2 wherein said indicia are color-coded and a first type of said indicia is a blank, a second type of said indicia is a single stripe, a third type of said indicia is a pair of stripes, a fourth type of said indicia is three stripes and a fifth type of said indicia is four marks.

4. A game set as in claim 1 wherein said total number of different game pieces is thirty-four, each said game piece having only one square-shaped playing surface, there being a total of four different types of said indicia, said game set being further characterized in that each of said type of said indicia appears a total number of thirty-four times, each of said type of said indicia appears at least once on each of nineteen playing surfaces, and each of said type of said indicia appears only once on each of nine playing surfaces, only twice on each of six playing surfaces, only three times on each of three playing surfaces, and on all four sides of only one playing surface.

5. A game set as in claim 4 wherein said indicia are color-coded and a first type of said indicia is a blank, a second type of said indicia is a single stripe, a third type of said indicia is a pair of stripes, and a fourth type of said indicia is three stripes.

6. A game set as in claim 1 wherein said total number of different game pieces is thirty, each said game piece having only one square-shaped playing surface, there being a total of four different types of said indicia, said game set being further characterized in that no playing surface has the same type of said indicia appear on all four sides thereof, and on all the playing surfaces at least two types of said indicia appear on respectively different sides thereof, each type of said indicia appears only two times on each of six playing surfaces and on opposite sides thereof, the third and fourth sides of each of the three of said six playing surfaces being occupied by respectively different combination of any two of the other three types of said indicia, and the third and fourth sides of each of the other three of said six playing surfaces being occupied by pairs of respective ones of the other three types of said indicia, each type of said indicia appears only three times on each of three playing surfaces, the fourth side of each of said three playing surfaces being occupied by respectively different type of the indicia, and each type of said indicia appears only once on each of nine other playing surfaces.

7. A game set as in claim 6 wherein said indicia are color-coded and a first type of said indicia is a blank, a second type of said indicia is a single stripe, a third type of said indicia is a pair of stripes, and a fourth type of said indicia is three stripes.

8. A game set as in claim 1 wherein said total number of different game pieces is twenty-seven, each said game piece having only one square-shaped playing surface, there being a total of four different types of indicia, said game set being further characterized in that no playing surface has the same type of indicia appear on all four sides thereof and on all the playing surfaces at least two said indicia appear on respectively different sides thereof, each type of said indicia appears only three times on each of three playing surfaces, the fourth side of each of said three playing surfaces being occupied by respectively different type of the indicia, and wherein only three playing surfaces have one pair of an identical first type of the indicia on two opposite sides of each playing surface in addition to another pair of any other different type of identical indicia on the two other opposite sides of said playing surface, and each type of said indicia appears only once on each of nine other playing surfaces.

9. A game set as in claim 8 wherein said indicia are color-coded and the first type of said indicia is a blank, a second type of said indicia is a single stripe, a third type of said indicia is a pair of stripes, and a fourth type of said indicia is three stripes.

10. A game set as in claim 1 wherein said total number of different game pieces is twenty-four, each said game piece having only one square-shaped playing surface, there being a total of four different types of indicia, said game set being further characterized in that no playing surface has the same type of indicia appear on all four sides thereof and on all the playing surfaces at least two types of said indicia appear on respectively different sides thereof, each type of said indicia appears only three times on each of three playing surfaces, the fourth side of each of said three playing surfaces being occupied by respectively different type of the indicia, each type of said indicia appears only once on each of nine pieces and appears only two times on each of three playing surfaces, and wherein no playing surface has a pair of identical indicia on two opposite sides in addition to another pair of different type of identical indicia on the other two opposite sides.

11. A game set as in claim 10 wherein said indicia are color-coded and a first type of said indicia is a blank, a second type of said indicia is a single stripe, a third type of said indicia is a pair of stripes, and a fourth type of said indicia is three stripes.

12. A game set as in claim 1 wherein said total number of different game pieces is six, each game piece being a three-dimensional six-faced die and having a total of six square-shaped playing surfaces, there being a total of thirty-six said playing surfaces, and characterized by four different types of said indicia, said game set being further characterized in that each of said type of said indicia appears a total number of thirty-four times, each of said type of said indicia appears at least once on each of nineteen of said playing surfaces, each of said type of said indicia appears only once on each of nine of said playing surfaces, only twice on each of six playing surfaces, only three times on each of three playing surfaces, and on all four sides of only one playing surface, and having upon two remaining playing surfaces two joker figures satisfying wild playing surfaces.

13. A game set as in claim 12 wherein said indicia are color-coded and a first type of said indicia is a blank, a second type of said indicia is a single stripe, a third type of said indicia is a pair of stripes, and a fourth type of said indicia is three stripes.

14. A method of playing a game following game criteria, with at least one player, using a game apparatus with a first predetermined total number of game pieces, wherein the game pieces when mutually arranged in side-by-side relationship with the other game pieces collectively form a playing pattern, comprising the steps of:

(a) removing the game pieces not desirable in the game according to the game criterion from the first predetermined total number of game pieces;

(b) shuffling the game pieces;

(c) dealing to the player a second predetermined number of said game pieces from the first predetermined total number of game pieces;

(d) following the game criteria selecting and arranging the game pieces into matching relationships and said playing pattern, by moving and rotating the selected game pieces in order to achieve a match;

(e) repeating the steps (c) and (d) until the first predetermined total number of said game pieces has been dealt, none of said game pieces can be matched or the game ceases; and (f) establishing a numerical score according to the game criteria by adding assigned numerical values of all matched game pieces.

15. The method of playing the game as in claim 14 wherein said game apparatus selected from the group that includes, first, a game set having the predetermined total number of the game pieces, including cards, tiles or dice, and second, a computer system having a microprocessor, a computer memory unit, an input unit, a video display unit and a software means, for playing a video game with said game set, and wherein each said game piece having an at least two-dimensional body and at least one geometrically identical playing surface;

each said playing surface of each said game piece having at least four sides and being symmetrical about a central dividing line;

each said playing surface upon each of its at least four sides is characterized by a selected indicia, chosen from at least four and maximum five different types of said indicia, wherein each said type of said indicia appears at least once on some of the playing surfaces, at least twice on some of the playing surfaces, at least three times on some of the playing surfaces, and at least four times on some of the playing surfaces;

each of said indicia having a different numerical significance and being laterally centered on the associated side of the playing surface, so as to facilitate alignment of two of said indicia whenever the playing surfaces of the two game pieces are placed in an abutting side-to-side relationship; and on each playing surface, where the particular type of said indicia appears only twice, it is on the opposite sides of the playing surface and not on the adjacent sides of said playing surface.

16. The method of playing the game as in claim 15 wherein the computer system is making game piece selection, simulating and evaluating the game by responding to inputs made by the player in accordance with the criteria stored in the computer memory unit, further comprising the steps of:

in response to the player's signal, initially determining which game pieces should be removed from the first predetermined total number of said game pieces;

selecting the second predetermined number of said game pieces according to the criteria stored in the computer memory unit;

displaying on said video display unit said selected game pieces to enable the player to use said input unit to further select a playing piece from said displayed game pieces;

upon selecting said playing piece, allowing a player to orient said game piece by rotating, placing and aligning it to correspond and match the other game pieces and achieve the playing pattern, according to the criteria or until time limit is reached;

analyzing the game by comparing the achieved playing pattern and matched game pieces according to the criteria stored in the computer memory unit;

determining optimum selection of said game pieces to maximize the score;

allowing the player an opportunity to select a different game piece from said game set;

constantly evaluating player's score by adding or subtracting points and displaying the score;

determining if an end-of-game signal is received and terminating the game; and at the end of the game determining the winner.

* * * * *